United States Patent [19]

MacEwen

[11] 4,444,308

[45] Apr. 24, 1984

[54] CONTAINER AND DISPENSER FOR CIGARETTES

[75] Inventor: George E. MacEwen, Kansas City, Mo.

[73] Assignee: Sealright Co., Inc., Kansas City, Mo.

[21] Appl. No.: 455,380

[22] Filed: Jan. 3, 1983

[51] Int. Cl.[3] ..... B65D 85/10; A24F 15/02

[52] U.S. Cl. ..... 206/249; 221/254; 221/260; 220/66; 206/804

[58] Field of Search ..... 206/249, 525, 804, 45.16; 221/254, 260; 220/66; 206/379

[56] References Cited

U.S. PATENT DOCUMENTS

| | | | |
|---|---|---|---|
| 1,448,326 | 3/1923 | Arnold | 221/64 |
| 1,504,599 | 8/1924 | Blackwood | 221/65 |
| 1,563,056 | 11/1925 | Williams et al. | 221/64 |
| 1,949,165 | 2/1934 | Krieger | 206/259 |
| 1,992,516 | 2/1935 | Valenta | 206/525 |
| 2,071,856 | 2/1937 | Segal | 206/249 |
| 2,355,250 | 8/1944 | Voss | 206/249 |
| 2,497,627 | 2/1950 | Pollack | 221/64 |
| 2,786,595 | 3/1957 | Nelson | 220/66 |
| 3,190,438 | 6/1965 | Cain et al. | 206/45.16 |
| 3,650,387 | 3/1972 | Hornsby et al. | 206/525 |
| 3,712,519 | 1/1973 | Collie | 222/563 |
| 3,874,567 | 4/1975 | Collie | 222/499 |

FOREIGN PATENT DOCUMENTS

| | | | |
|---|---|---|---|
| 100183 | 2/1937 | Australia | 220/66 |
| 605428 | 7/1933 | Fed. Rep. of Germany | 221/260 |
| 315487 | 8/1956 | Fed. Rep. of Germany | 206/249 |
| 1119542 | 4/1956 | France | 220/66 |
| 214920 | 5/1924 | United Kingdom | 221/260 |
| 342909 | 2/1931 | United Kingdom . | |
| 1385540 | 2/1975 | United Kingdom | 206/249 |

*Primary Examiner*—William T. Dixson, Jr.
*Assistant Examiner*—Brenda J. Ehrhardt
*Attorney, Agent, or Firm*—Kokjer, Kircher, Bradley, Wharton, Bowman & Johnson

[57] ABSTRACT

A disposable container for cigarettes, cigars, cigarillos and similar articles. The container includes a generally cylindrical tubular body having an inwardly rolled lower rim at the lower end thereof engaging a generally circular bottom closure disc sealed within the body in abutment with the lower rim. The bottom closure disc is formed of relatively thin resilient sheet material such as thermoplastic synthetic resin material. One embodiment of the bottom closure is configured in the shape of at least two concentric, interconnected, frustroconical portions so that the bottom closure is bistable in a first position extending generally across the tubular body and alternately, in a second position extending upwardly into the tubular body thus displacing at least a portion of the contents upwardly out of the over upper end of the container. In another embodiment, the bottom closure shape is characterized by four concentric, interconnected frustoconical portions which provides two stages of upward extension into the tubular body for displacing the container contents upwardly. Also disclosed is a removable seal across the upper end face of the open upper end of the container and two forms of removable lids to be closely received over the sealed or unsealed upper end of the container. Extension and retraction of the bottom closure discs are accomplished by the application of external force thereto.

42 Claims, 18 Drawing Figures

CONTAINER AND DISPENSER FOR CIGARETTES

The present invention relates generally to improvements in containers. In one aspect the invention relates to improved container structure. In another aspect the invention relates to improved container construction technique.

It is presently known to package tobacco smoking articles, such as premium cigarettes, in cylindrically shaped, injection molded plastic containers with corresponding cylindrically shaped, injection molded plastic lids. In order to facilitate removal of the cigarettes from the container, especially when the container is completely filled, these molded plastic containers are shorter than the cigarettes packaged therein, and all the cigarettes in the container extend a substantial distance beyond the open upper end of the container so that they can be grasped by the fingers for removal from the container. The molded plastic lid is configured to be received over the ends of the cigarettes as well as to be partially received around the outer surface of the container for protection of the cigarettes during handling and shipping of the package.

The above-described cigarette package has a number of disadvantages. First of all, a two-piece injection molded plastic cigarette container is very expensive for such an application. Furthermore, when the lid is removed from such a container, the container fails to provide adequate protection for the fragile exposed tips of the cigarettes which, at all times, extend beyond the open upper end of the container. The exposed tips of the cigarettes are even more vulnerable to being damaged by the lid when the lid is replaced on the container due to the close proximity of the lid sidewall to the exposed cigarette tips as the lid is being refitted on the container.

Accordingly, it is an object of the present invention to provide a container which overcomes the deficiencies of previously used containers of tobacco products.

Another object of the invention is to reduce the cost of a container suitable for packaging tobacco products.

A further object of the invention is to provide an economical method for the production of a container suitable for packaging tobacco products.

A still further object of the invention is to provide a container which provides increased protection for the contents thereof.

Yet another object of the invention is to provide a container which facilitates the removal of the contents thereof.

Still another object of the invention is to provide a container which is attractive to the eye, economical to produce, protective of its contents and simple and convenient to use.

The present invention contemplates a container which includes a generally cylindrical tubular body having upper and lower end portions. The container further includes closure means for installation in the lower end portion of the tubular body which comprises a generally circular disc. The generally circular disc is configured to include a generally planar circular central portion and a first frustoconical portion having an upper end portion and a lower end portion and communicating at the upper end portion with the circular central portion and tapering outwardly from the circular central portion toward the lower end portion of the first frustoconical portion. The disc is further provided with a first annular upwardly concave portion communicating with the lower end portion of the first frustoconical portion and facing toward the upper end portion of the first frustoconical portion. The disc also includes a second frustoconical portion having a lower end portion and an upper end portion and communicating at the lower end portion thereof with the first annular upwardly concave portion and tapering outwardly from the first annular upwardly concave portion toward the upper end portion of the second frustoconical portion. The configuration of the disc is further defined by a first annular downwardly concave portion communicating with the upper end portion of the second frustoconical portion and facing toward the lower end portion of the second frustoconical portion. A third frustoconical portion having an upper end portion and a lower end portion is provided on the disc and communicates at the upper end portion thereof with the first annular downwardly concave portion and tapers outwardly from the first annular downwardly concave portion toward the lower end portion of the third frustoconical portion. The lower end portion of the third frustoconical portion communicates with a second annular upwardly concave portion which faces toward the upper end portion of the third frustoconical portion. The configuration of the generally circular disc permits the disc to be pressed upwardly into the tubular body to correspondingly extend one or more of the elements contained therein, for examples, cigarettes, upwardly beyond the upper end portion of the tubular body to facilitate grasping and removing the thus extending elements from the tubular body. The configuration of the generally circular disc permits it to snap from its normal downward position to its extended upward position in response to such upward pressure, and to remain in this extended upward position until returned to its normal downward position by snap action in response to opposite downward pressure applied to the generally circular disc, such as, for example, by means of downward pressure exerted on the contents remaining in the container.

The present invention further contemplates a method of assembling such a container as that described above. The method includes the production of a generally circular disc from a mass of resilient material and the forming of the thus produced generally circular disc into the configuration described in the previous paragraph. The method further includes positioning a generally cylindrically shaped tubular container sidewall having an inner surface and an outer surface and upper and lower open ends around the thus formed generally circular disc with the generally circular disc portion adjacent the lower open end of the tubular container sidewall with the first annular upwardly concave portion of the generally circular disc facing toward the upper open end of the tubular container sidewall. The lower open end of the tubular container sidewall is then formed into a radially inwardly rolled lip in abutting relation with the generally circular disc. The method further includes applying adhesive means along the periphery of the generally circular disc communicating between the circular disc and the tubular container sidewall so as to form an at least partially assembled container. This method provides a simple and economical procedure for producing a container which can extend its contents for easy removal by the upward snap action up the generally circular disc in response to upward pressure applied thereto from below.

Other aspects, objects and advantages of the present invention will be apparent from the following detailed description and appended claims when read with reference to the accompanying drawings in which:

Figure 1:
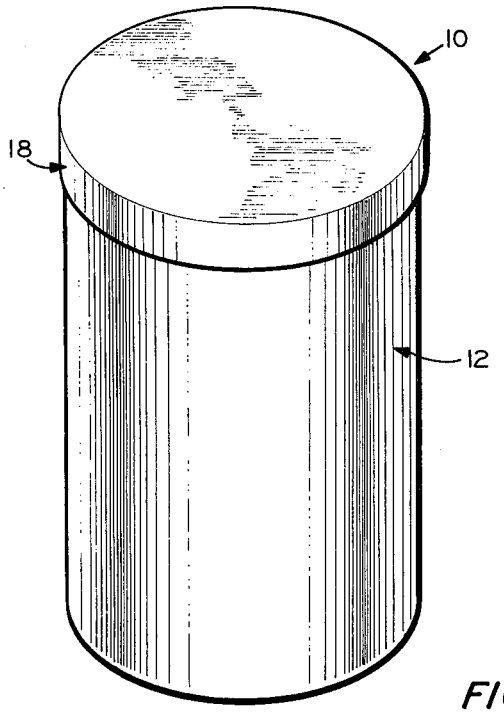
FIG. 1 is an axonometric view of a container constructed in accordance with the present invention showing the removable lid on the container body.
Figure 2:
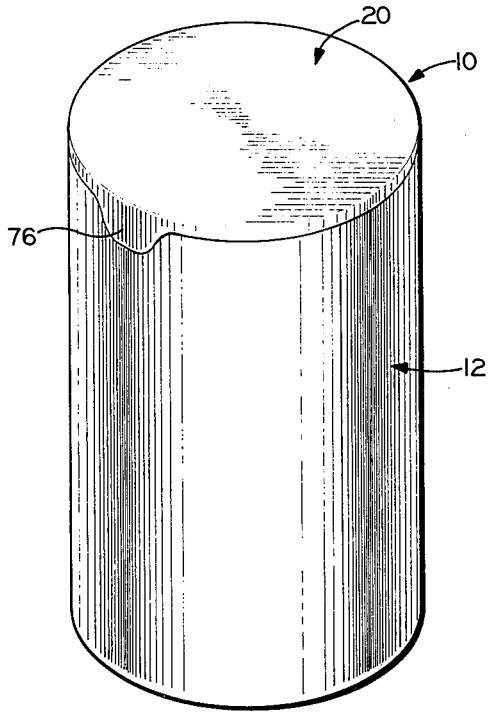
FIG. 2 is an axonometric view of the container of FIG. 1 with the lid removed and showing a removable closure seal releasably adhered to annular end face of the upper end of the container body to seal the contents within the container body.
Figure 3:
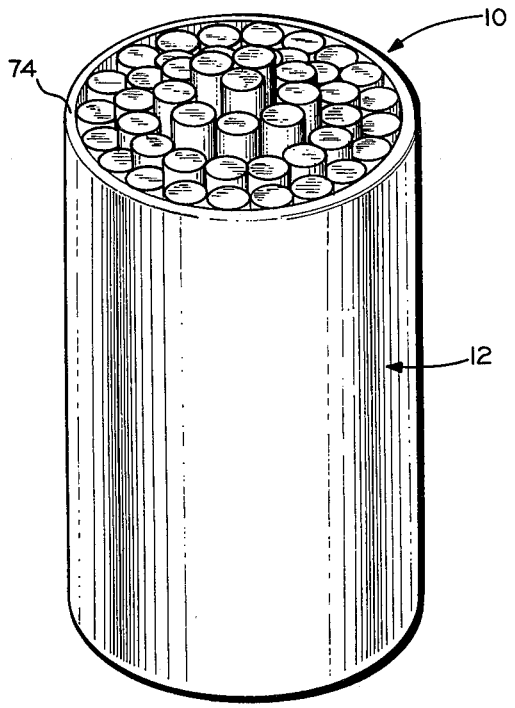
FIG. 3 is an axonometric view of the container of FIG. 1 with the removable closure seal removed and showing cigarettes contained therein extended above the open upper end of the container body to facilitate their removal from the container.

Referring now to the drawings, and to FIGS. 1-10 in particular, a container, suitable for packaging tobacco products such as cigarettes, cigars and cigarillos, and constructed in accordance with the present invention, is generally designated by the reference character 10. The container 10 comprises a generally cylindrically shaped tubular body or sidewall 12, preferably constructed of a polyethylene-coated, food-grade paperboard. The paperboard may be foil-laminated on one or both sides thereof. While any type of material can be employed in the construction of the tubular sidewall 12 which will provide the desired physical strength and handling characteristics for the intended contents thereof, it is presently preferred to employ a polyethylene-coated, foil-laminated, food-grade paperboard having a thickness of about 0.017 inch (0.43 mm) and having a conventional overlapped side seam 14, which seam is formed by applying sufficient heat and pressure to the overlapped portions of the sidewall to cause autogenous bonding of the superposed polyethylene-coated surfaces thereof. One such suitable paperboard is available from International Paper Company and is designated as 17 point solid bleached kraft, foil-laminated, polyethylene-coated on both sides. The container 10 also comprises a container bottom closure 16, a container lid 18 and a container top closure seal 20.

The bottom closure 16 can be made of any suitable material, however the closure 16 is preferably formed of a unitary homogeneous mass of resilient plastic material such as a synthetic resin material. Examples of suitable synthetic resin material for use in constructing the bottom closure 16 include normally solid thermoplastic materials comprising at least one alpha olefin polymer. Another suitable synthetic resin material is rubberized styrene such as that available from The Firestone Tire & Rubber Company under the trademark Sterion. Examples of suitable alpha olefin polymers include high density polyethylene, low density polyethylene and polypropylene, with low density polyethylene being presently preferred. It is further presently preferred to construct the bottom closure 16 from a sheet of low density polyethylene having a uniform thickness of about 0.030 inch (0.76 mm). The bottom closure 16 is preferably formed into the desired configuration of uniform thickness by the application of heat and pressure to a generally circular disc of such suitable material by means of the technique generally referred to as thermoforming.

Figure 8:
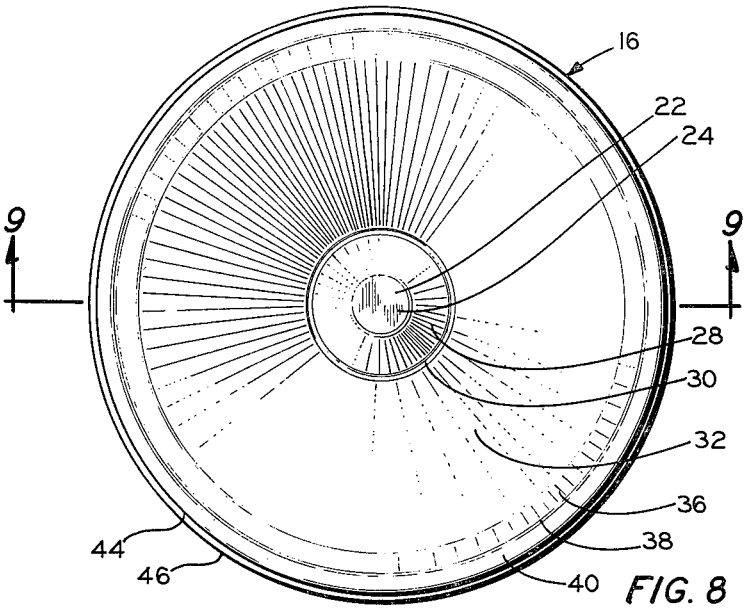
FIG. 8 is an enlarged top plan view of a bottom closure disc constructed in accordance with the present invention.
Figure 9:
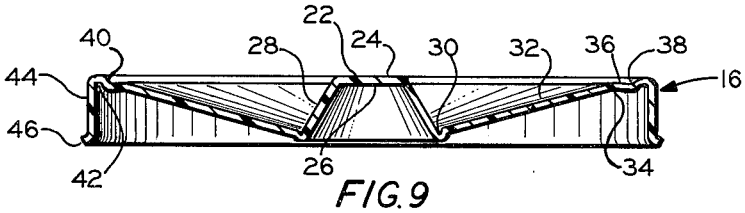
FIG. 9 is a cross sectional view taken along line 9—9 of FIG. 8.
Figure 10:
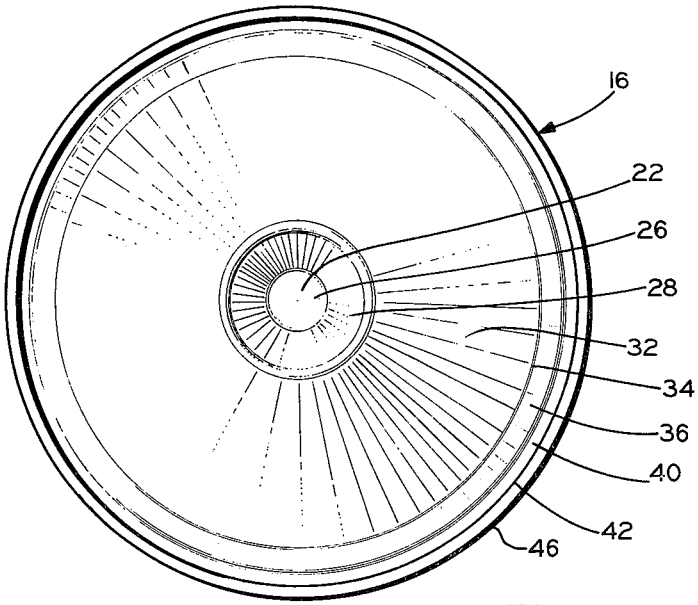
FIG. 10 is a bottom plan view of the bottom closure disc of FIG. 8.

The desired configuration of the bottom closure 16 is that of a generally circular disc. The generally circular disc comprises a generally planar circular central portion 22 having an upper side 24 and a lower side 26. A first tapered portion 28, preferably a frustoconical portion, having an upper end portion and a lower end portion, communicates at the upper end portion thereof with the central portion 22 and tapers downwardly and outwardly from the central portion 22 toward the lower end portion of the first frustoconical portion 28. A first annular upwardly concave portion 30 communicates with the lower end portion of the first frustoconical portion 28. A second tapered portion 32, preferably a frustoconical portion, having a lower end portion and an upper end portion, communicates at the lower end portion thereof with the first annular upwardly concave portion 30 and tapers upwardly and outwardly from the first annular upwardly concave portion toward the upper end portion of the second frustoconical portion 32. A first annular downwardly concave portion 34 communicates with the upper end portion of the second frustoconical portion 32. A third tapered portion 36, preferably a frustoconical portion having an upper end portion and a lower end portion, communicates at the upper end portion thereof with the first annular downwardly concave portion 34 and tapers downwardly and outwardly from the first annular downwardly concave portion 34 toward the lower end portion of the third frustoconical portion 36. A second annular upwardly concave portion 38 communicates with the lower end portion of the third frustoconical portion 36. A fourth tapered portion 40, preferably a frustoconical portion, having a lower end portion and an upper end portion, communicates at the lower end portion thereof with the second annular upwardly concave portion 38 and extends upwardly and outwardly therefrom toward the upper end portion of the fourth frustoconical portion. The upper end portion of the fourth frustoconical portion communicates with a second annular downwardly concave portion 42, which second annular downwardly concave portion 42 in turn communicates with the upper end portion of a downwardly extending, generally cylindrical skirt 44, which skirt terminates at the lower end portion thereof in a radially outwardly extending flange portion 46. The circular central portion 22, the frustoconical portions 28, 32, 36 and 40, the annular concave portions 30, 34, 38, and 42, the skirt 44, and the flange portion 46 are coaxially aligned as best shown in FIGS. 8, 9 and 10.

The ratio of the diameter of the circular outer periphery of the skirt 44 to the diameter of the circular central portion 22 of the closure 16 suitably falls generally within the range from about 4 to about 12, and more preferably in the range from about 6 to about 8. In one embodiment of the closure 16, such a ratio of about 7.2 provides good results.

The apical angle of the first tapered portion 28 of the closure 16, when in the shape of a frustum of a cone, is generally in the range from about 0° to about 120°, preferably in the range from about 45° to about 115°, and more preferably in the range from about 45° to about 75°. In a presently preferred embodiment, the apical angle of the frustoconical first tapered portion 28 is about 60°. The apical angle of the second tapered portion 32, when in the shape of a frustum of a cone, is generally in the range from about 45° to about 165°, preferably in the range from about 115° to about 165°, and more preferably in the range from about 135° to about 165°. In a presently preferred embodiment, the apical angle of the frustoconical second tapered portion 32 is about 150°. The apical angle of the third tapered portion 36, when in the shape of a frustum of a cone, is generally in the range from about 85° to about 185°, preferably in the range from about 135° to about 185°, and more preferably in the range from about 150° to about 185°. In a presently preferred embodiment, the apical angle of the frustoconical third tapered portion 36 is about 168°. The apical angle of the fourth tapered portion 40, when in the shape of the frustum of a cone, is generally in the range from about 115° to about 180°, preferably in the range from about 115° to about 165°, and more preferably in the range from about 135° to about 165°. In a presently preferred embodiment, the apical angle of the frustoconical fourth tapered portion 40 is about 150°.

Figure 11:
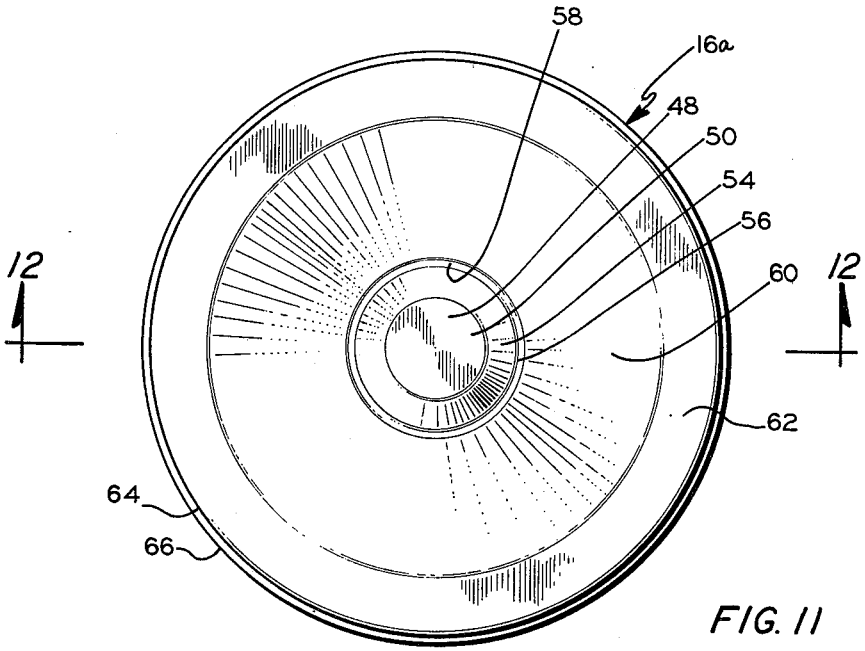
FIG. 11 is an enlarged top plan view of an alternate form of a bottom closure disc constructed in accordance with the present invention.
Figure 12:
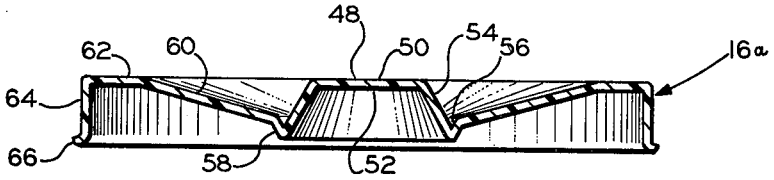
FIG. 12 is a cross sectional view taken along line 12—12 of FIG. 11.
Figure 13:
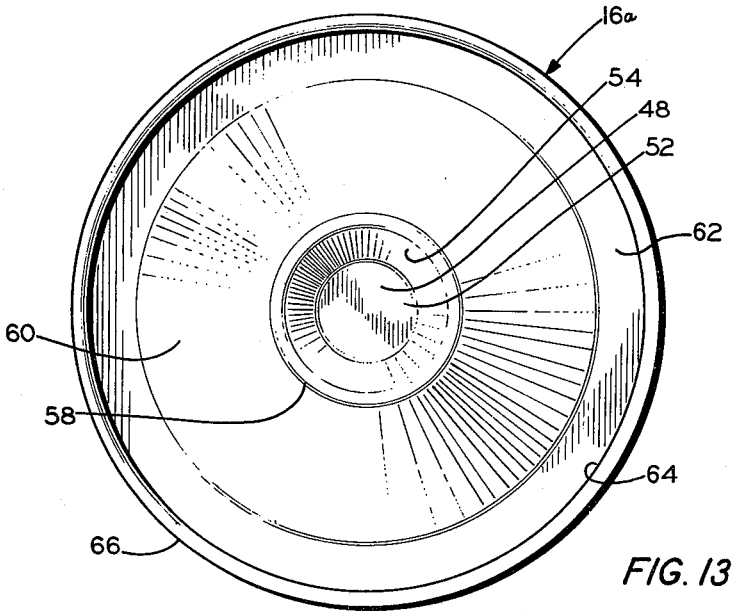
FIG. 13 is a bottom plan view of the bottom closure disc of FIG. 11.

Referring now to FIGS. 11–13, an alternate form of bottom closure disc is illustrated therein and is generally designated by the reference character **16*a*. The bottom closure 16*a* can be made of any of the materials described above for the bottom closure 16. The desired configuration of the bottom closure 16 is that of a generally circular disc. The generally circular disc comprises a generally plain or circular central portion 48 having an upper side 50 and a lower side 52. A first tapered portion 54, preferably a frustoconical portion, having an upper end portion and a lower end portion, communicates at the upper end portion thereof with the central portion 48 and tapers downwardly and outwardly from the central portion 48 toward the lower end portion of the first frustoconical portion 54. A first annular upwardly concave portion 56 communicates with the lower end portion of the first frustoconical portion 54. A second tapered portion 58, preferably a frustoconical portion having a lower end portion and an upper end portion, communicates at the lower end portion thereof with the first annular upwardly concave portion 56 and tapers upwardly and outwardly from the first annular upwardly concave portion 56 toward the upper end portion of the second frustoconical portion 58. A third tapered portion 60, preferably a frustoconical portion, having an upper end portion and a lower end portion, communicates at the lower end portion thereof with the upper end portion of the second frustoconical portion 58 and tapers upwardly and outwardly from the second frustoconical portion 58 toward the upper end portion of the third frustoconical portion 60. A generally laterally extending annular portion 62 communicates between the upper end portion of the third frustoconical portion 60 and the upper end portion of a generally cylindrical downwardly extending skirt 64, which skirt 64 extends toward the lower end portion of the second frustoconical portion and terminates at the lower end portion thereof in a radially outwardly extending flange portion 66. The circular central portion 48, the frustoconical portions 54, 58 and 60, the annular concave portion 56, the generally cylindrical skirt 64 and the flange portion 66 are coaxially aligned as best shown in FIGS. 11 and 13**.

The ratio of the diameter of the circular outer periphery of the skirt 64 to the diameter of the circular central portion 48 of the closure **16*a* suitably falls within the range from about 4 to about 12, and more preferably within the range from about 4 to about 6. In one embodiment of the closure 16*a***, such a ratio of about 5 is deemed advantageous.

The apical angle of the first tapered portion 54 of the closure **16*a*, when in the shape of a frustum of a cone, is generally in the range from about 0° to about 120°, preferably in the range from about 45° to about 115°, and more preferably in the range from about 45° about 75°. In a presently preferred embodiment, the apical angle of the frustoconical first tapered portion 54 is about 60°. The apical angle of the second tapered portion 58, when in the shape of a frustum of a cone, is generally in the range from about 45° to about 165° and preferably in the range from about 45° to about 75°. In a presently preferred embodiment, the apical angle of the frustoconical second tapered portion 58 is about 60°. The apical angle of the third tapered portion 60, when in the shape of a frustum of a cone, is generally in the range from about 85° to about 185°, and more preferably in the range from about 135° to about 165°. In a presently preferred embodiment, the apical angle of the frustoconical third tapered portion 60** is about 150°.

Figure 4:
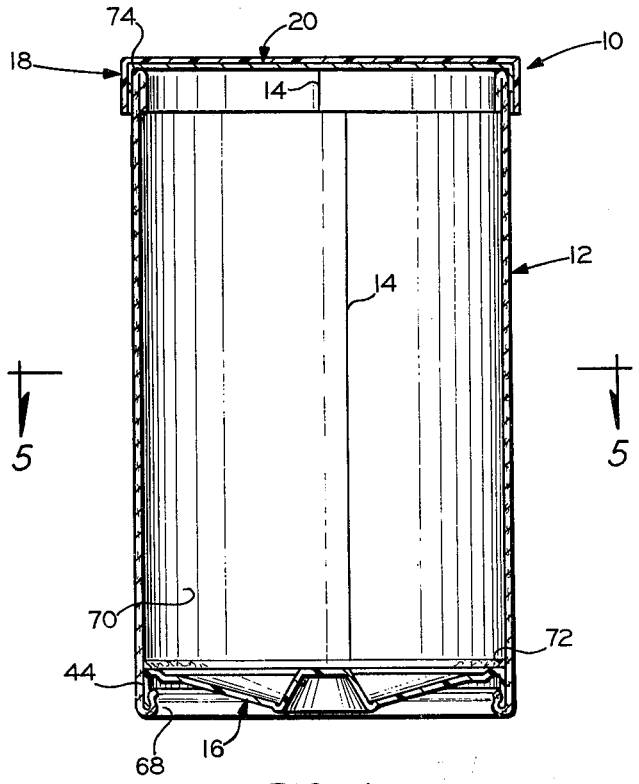
FIG. 4 is a vertical cross sectional view taken along the longitudinal axis of an empty container constructed in accordance with the present invention.
Figure 5:
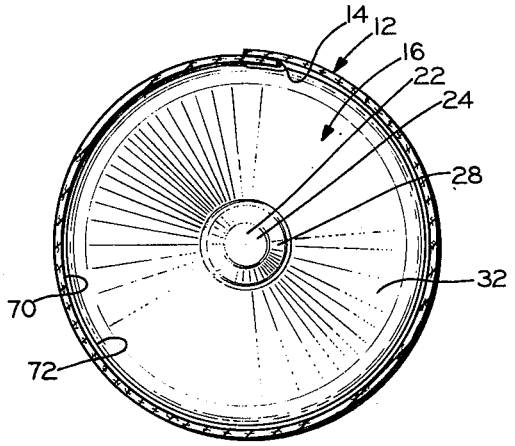
FIG. 5 is a horizontal cross sectional view of the container of FIG. 4 taken along line 5—5 of FIG. 4.
Figure 6:
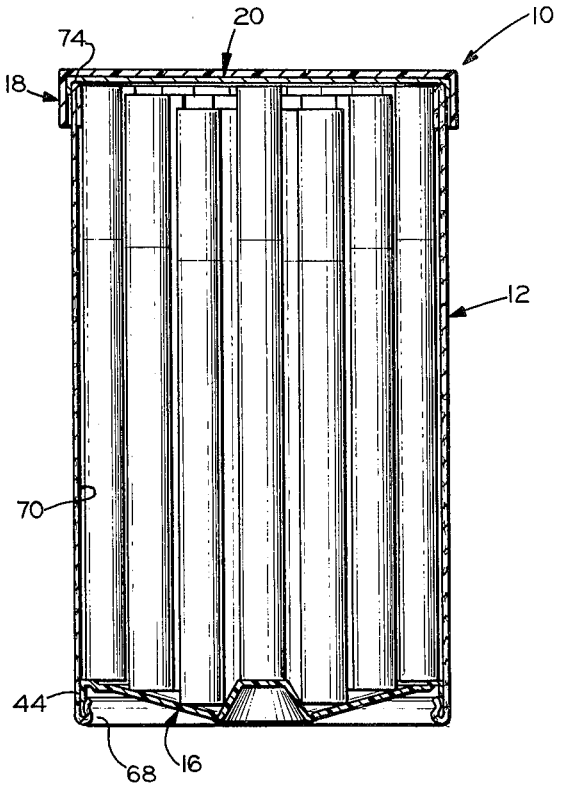
FIG. 6 is a vertical cross sectional view similar to FIG. 4 but illustrating the container filled with cigarettes.
Figure 7:
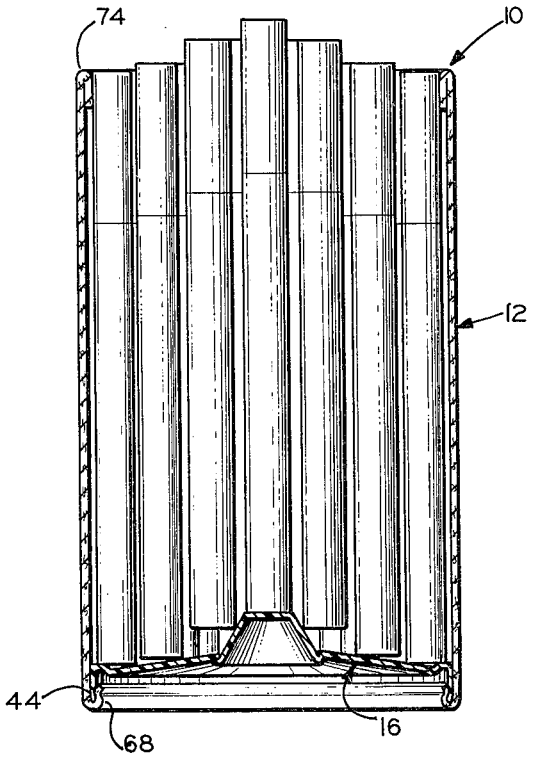
FIG. 7 is a vertical cross sectional view similar to FIG. 6 but illustrating the container with the lid and closure seal removed and with the bottom closure disc of the container snapped into its extended upward position extending the cigarette contents above the open upper end of the container body to facilitate their removal from the container.

As shown FIGS. 4, 6 and 7, the tubular sidewall 12 is preferably provided with a radially inwardly rolled lip 68 formed on the lower end portion of the tubular sidewall 12. The lip 68 is rolled about and firmly engages the downwardly extending skirt 44 of the bottom closure 16, or, in an alternate embodiment, the downwardly extending skirt 64 of the slightly modified bottom closure **16*a*. In addition to this crimped engagement between the inwardly rolled lip 68 and the downwardly extending flange of the bottom closure 16, the bottom closure is further fixedly secured in abutting relation with the inwardly rolled lip 64 by means of a continuous circumferential bead or fillet of suitable adhesive communicating between the periphery of the bottom closure and the inner surface 70 of the tubular sidewall 12 as shown at 72. The continuous circumferential fillet of adhesive 72 provides a fluid tight seal between the bottom closure 16 or 16***a* and the tubular sidewall 12.

The open upper end portion of the tubular sidewall 12 is characterized by an annular end face 74 which is preferably formed by folding the open upper end of the tubular container sidewall inwardly and downwardly against the inner surface 70 thereof.

The removable top closure seal 20 is adapted to be applied over the annular end face 74 and sealed thereto by suitable means to provide a fluid tight seal for the contents of the container 10. The removable seal 20 can be of any suitable shape capable of covering the opening defined by the annular end face 74 and is preferably provided with means thereon which can serve as a pull tab, as shown at 76, to facilitate the removal of the seal 20 from the annular end face 74 of the tubular body or sidewall 12. The seal 20 can be made of any suitable material, such as, for example, plastic tape with adhesive applied to one surface thereof or, more preferably, a metal foil, such as aluminum coated on one surface with a pressure- or heat-sensitive adhesive. In either case, the adhesive-coated side of the seal 20 is pressed against the annular end face 74 of the tubular body 12 and is secured thereto by application of pressure or of heat and pressure as required. It is presently preferred to utilize the previously mentioned metal foil with a heat-sensitive adhesive on one surface thereof which is secured to the annular end face 74 by means of heat and pressure applied to the seal 20 in the form of a heated ring of approximately the diameter of the annular end face 74.

Referring now to FIGS. 14–18, an alternate form of container, suitable for packaging tobacco products such as cigars and cigarillos, constructed in accordance with the present invention, is generally designated by the reference character 10*a*. The container 10*a* comprises a modified generally cylindrically shaped tubular body or sidewall 12*a*, preferably constructed of a polyethylene-coated, food-grade paperboard, such as that described above for the sidewall 12. The container 10*a* also comprises a container bottom closure 16*b*, a container lid 18*a* and a container top closure seal 20*a*.

The bottom closure 16*b* can be made of any suitable material, however, the closure 16*b* is preferably formed of a unitary homogeneous mass of resilient plastic material such as a synthetic resin material. Examples of suitable synthetic resin material for use in constructing the bottom closure 16*b* include normally solid thermoplastic materials comprising at least one alpha olefin polymer. Another suitable synthetic resin material is rubberized styrene such as that available from The Firestone Tire & Rubber Company under the trademark Sterion. Examples of suitable alpha olefin polymers include high density polyethylene, low density polyethylene and polypropylene. It is presently preferred to construct the bottom closure 16*b* from a sheet of rubberized styrene, for example the rubberized styrene sold under the trademark Sterion, having a uniform thickness of about 0.018 inch (0.46 mm). The bottom closure 16*b* is preferably formed in the desired configuration of uniform thickness by the application of heat and pressure to a generally circular disc of such suitable material by means of the technique generally referred to as thermoforming.

Figure 16:
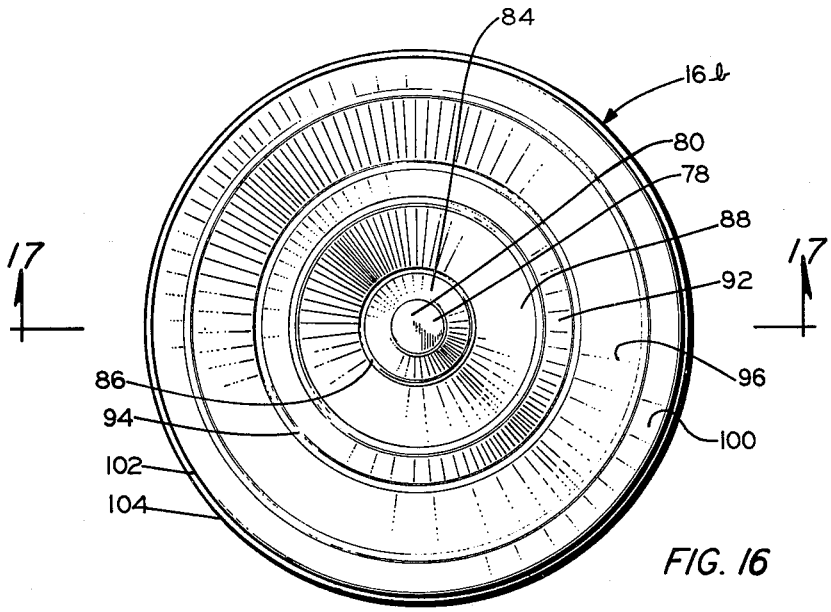
FIG. 16 is a top plan view of another form of a bottom dome disc constructed in accordance with the present invention.
Figure 17:
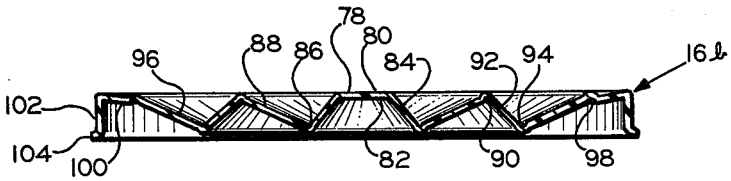
FIG. 17 is a cross sectional view taken along line 17—17 of FIG. 16.
Figure 18:
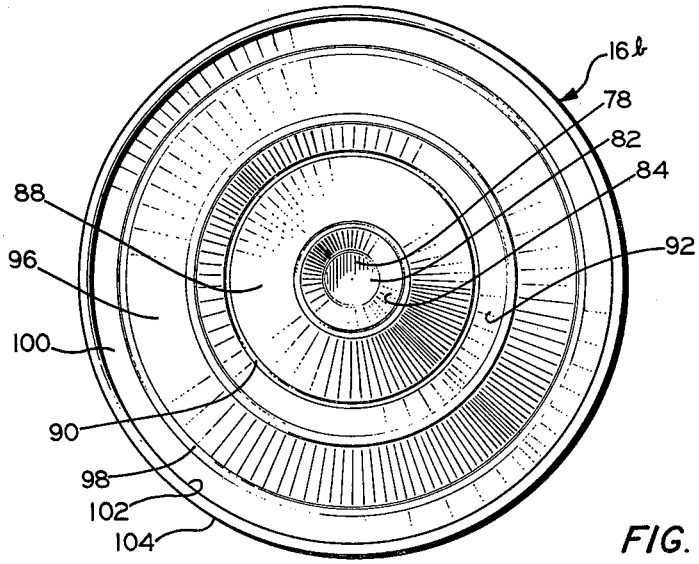
FIG. 18 is a bottom plan view of the bottom dome disc of FIG. 16.

The desired configuration of the bottom closure 16*b* is that of a generally circular disc. The generally circular disc comprises a generally planar circular central portion 78 having an upper side 80 and a lower side 82. A first tapered portion 84, preferably a frustoconical portion, having an upper end portion and a lower end portion, communicates at the upper end portion thereof with the central portion 78 and tapers downwardly and outwardly from the central portion 78 toward the lower end portion of the first frustoconical portion 84. A first annular upwardly concave portion 86 communicates with the lower end portion of the first frustoconical portion 84. A second tapered portion 88, preferably a frustoconical portion, having a lower end portion and an upper end portion, communicates at the lower end portion thereof with the first annular upwardly concave portion 86 and tapers upwardly and outwardly from the first annular upwardly concave portion 86 toward the upper end portion of the second frustoconical portion 88. A first annular downwardly concave portion 90 communicates with the upper end portion of the second frustoconical portion 88. A third tapered portion 92, preferably a frustoconical portion, having an upper end portion and a lower end portion, communicates at the upper end portion thereof with the first annular downwardly concave portion 90 and tapers downwardly and outwardly from the first annular downwardly concave portion 90 toward the lower end portion of the third frustoconical portion 92. A second annular upwardly concave portion 94 communicates with the lower end portion of the third frustoconical portion 92. A fourth tapered portion 96, preferably a frustoconical portion, having a lower end portion and an upper end portion, communicates at the lower end portion thereof with the second annular upwardly concave portion 94 and extends upwardly and outwardly therefrom toward the upper end portion of the fourth frustoconical portion 96. The upper end portion of the fourth frustoconical portion communicates with a second annular downwardly concave portion 98, which second annular downwardly concave portion 98 in turn communicates with the inner portion of a generally laterally extending annular portion 100. The periphery of the generally laterally extending annular portion 100 communicates with the upper end portion of a downwardly extending, generally cylindrical skirt 102, which skirt terminates at the lower end portion thereof in a radially outwardly extending flange portion 104. The circular central portion 78, the frustoconical portions 84, 88, 92 and 96, the annular concave portions 86, 90, 94 and 98, the generally laterally extending annular portion 100, the skirt 102, and the flange portion 104 are coaxially aligned as best shown in FIGS. 16 and 18.

The ratio of the diameter of the circular outer periphery of the skirt 102 to the diameter of the circular central portion 78 of the closure 16*b* suitably falls within the range from 4 to about 12, and more preferably within the range from about 9 to about 12. In one embodiment of the closure 16*b*, such a ratio of about 10 is deemed advantageous.

The apical angle of the first tapered portion 84 of the closure 16*b*, when in the shape of a frustum of a cone, is generally in the range from about 0° to about 120°; preferably in the range from about 45° to about 115°, and more preferably in the range from about 85° to about 115°. In a presently preferred embodiment, the apical angle of the frustoconical first tapered portion 84 is about 100%. The apical angle of the second tapered portion 88, when in the shape of a frustum of a cone, is generally in the range from about 45° to about 165°, preferably in the range from about 115° to about 165°, and more preferably in the range from about 115° to about 145°. In a presently preferred embodiment, the apical angle of the frustoconical second tapered portion 88 is about 130°. The apical angle of the third tapered portion 92, when in the shape of a frustum of a cone, is generally in the range from about 85° to about 185°, preferably in the range from about 85° to about 165°, and more preferably in the range from about 85° to about 115°. In a presently preferred embodiment, the apical angle of the frustoconical third tapered portion 92 is about 100°. The apical angle of the fourth tapered portion 96, when in the shape of the shape of a frustum of a cone, is generally in the range from about 115° to about 180°, preferably in the range from about 115° to about 165°, and more preferably in the range from about 115° to about 145°. In a presently preferred embodiment, the apical angle of the frustoconical fourth tapered portion is about 150°.

Figure 14:
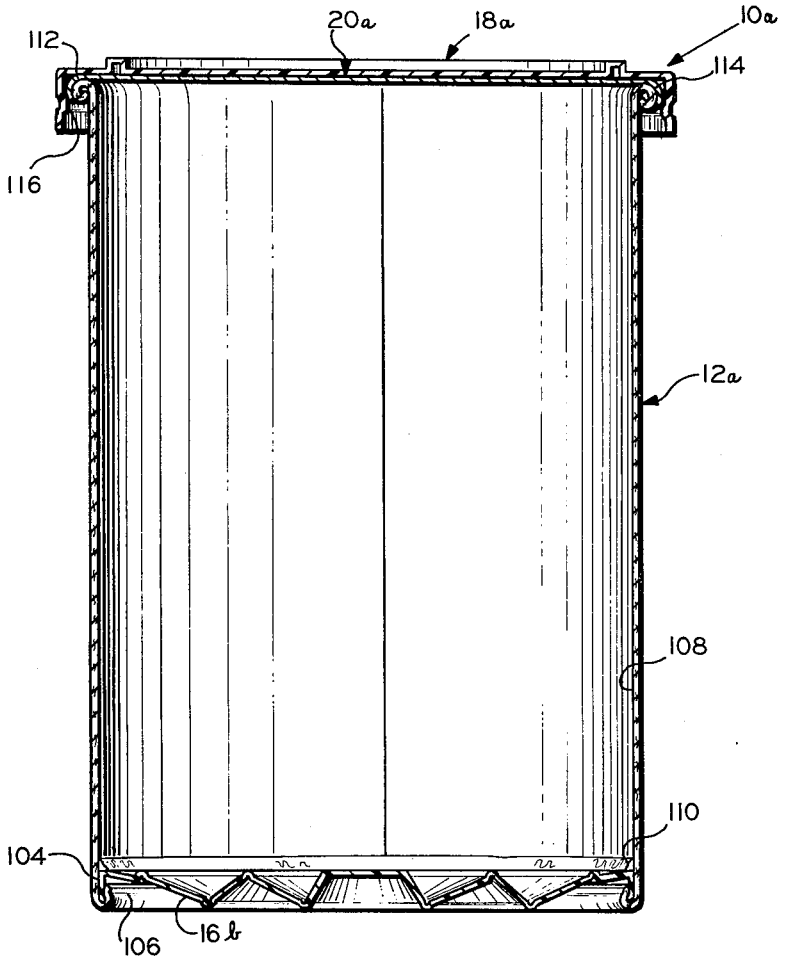
FIG. 14 is a vertical cross sectional view taken along the longitudinal axis of an alternate form of an empty container constructed in accordance with the present invention.
Figure 15:
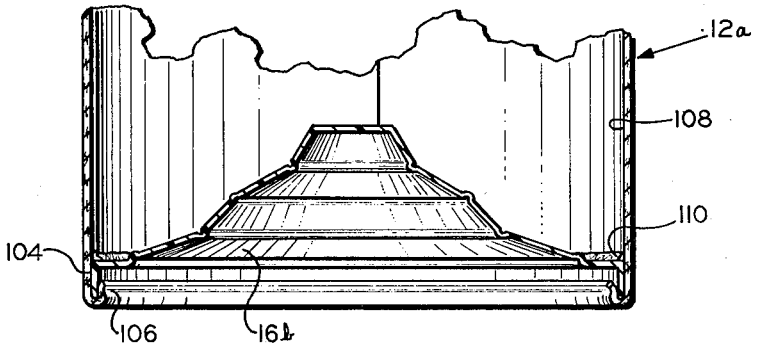
FIG. 15 is a partial vertical cross sectional view of the lower portion of the container of FIG. 14 illustrating the bottom closure disc of the container snapped into its extended upward position.

As best shown in FIGS. 14 and 15, the lower end portion of the tubular body or sidewall 12*a* of the container 10*a* is closed by the bottom closure 16*b* which is positioned in abutting relation to a radially inwardly rolled lip 106 formed on the lower end portion of the tubular sidewall 12*a* and enfolding the downwardly extending flange portion 104 of the bottom closure 16*b*. The bottom closure 16*b* is fixedly secured in this abutting relation with the lip 106 by means of a continuous circumferential bead or fillet of suitable adhesive communicating between the periphery of the bottom closure 16*b* and the inner surface 108 of the tubular sidewall 12*a* as shown at 110. The continuous circumferential fillet of adhesive 110 provides a fluid-tight seal between the bottom closure 16*b* and the tubular sidewall 12*a*.

An annular end face 112 is formed on the upper end portion of the tubular body or sidewall 12*a* by means of a radially outwardly rolled lip 114. A suitable top closure seal 20*a*, such as that previously described for the top closure seal 20 is removably sealingly engaged with the annular end face 112 of the tubular body 12*a* in order to seal the contents of the container 10*a*. A removable lid 18*a* further closes the upper end portion of the tubular body 12*a* and is removably retained on the upper end portion of the tubular body 12*a* by means of a radially inwardly extending annular rib 116 which abuttingly engages the lower edge of the outwardly rolled lip 114 when the lid 18*a* is in the closed position on the container 10*a*. The lid 18*a* can be formed of any of the materials described above for the construction of the bottom closure 16*b*, and is preferably formed of the same material as is selected for the construction of the bottom closure 16*b*.

Assembly of either of the containers 10 or 10*a* can be achieved in the following manner. Each bottom closure 16, 16*a* or 16*b*, is positioned by a suitable bottom feeder mechanism on the outer end of a respective mandrel with the bottom closure being retained on the mandrel by the means of vacuum applied to the mandrel. The bottom closure is positioned on the mandrel with the skirt of the bottom closure extending away from the mandrel. The mandrel securing the respective bottom closure is then moved or indexed to a position adjacent a suitable sidewall feeder at which point a respective flat, generally rectangular sidewall blank, having first and second parallel side edge portions and first and second end faces, is first heated along its first and second parallel side edge portions which will ultimately be overlapped, and is then positioned adjacent to and clamped on the cylindrical outer surface of the mandrel carrying the bottom closure. The mandrel carrying the bottom closure and sidewall blank is then moved or indexed to a position adjacent a suitable sidewall wrapper mechanism at which time the sidewall blank is wrapped about the cylindrical outer surface of the mandrel and the previously heated parallel side edge portions are overlapped and clamped together and allowed to cool, thereby forming the overlapped side seam 14 when the superposed, heated, thermoplastic coated layers become autogenously bonded together to form the tubular body or sidewall 12 or 12*a*.

The mandrel carrying the thus formed tubular sidewall 12 or 12*a* and bottom closure 16, 16*a* or 16*b* is then moved or indexed to a position adjacent a suitable bond heater where the thermoplastic coating of the tubular sidewall at the end thereof adjacent the bottom closure can be optionally heated to a suitable bonding temperature of the thermplastic coating. If desired, this heating step can be omitted, although the mandrel will still be indexed to and from this position in the operation of the conventional container manufacturing apparatus described in U.S. Pat. No. 4,072,226. The mandrel carrying the tubular sidewall and bottom closure is then moved or indexed to a position adjacent a rotating bottom sealing head which moves in coaxial alignment with the tubular sidewall into engagement with the either heated or unheated continuous edge of the lower end portion of the tubular sidewall adjacent the bottom closure, and rolls the continuous edge inwardly, thereby forming a radially, inwardly rolled lip which abuttingly engages the outer periphery of the respective bottom closure and firmly enfolds the generally cylindrical skirt thereof.

After formation of the rolled lip engaging the bottom closure, the rotating bottom sealing head is then withdrawn from the thus formed rolled lip and the mandrel carrying the partially assembled container comprising a tubular sidewall and a bottom closure secured thereto is moved or indexed to a dothing position where the partially assembled container is removed by suitable means from the mandrel and conveyed away by suitable conveyor means to a finishing station. At the finishing station, the partially assembled container is grasped at the bottom end thereof adjacent the bottom closure by a suitable rotating head and is rotated thereby about the longitudinal axis of the tubular sidewall during which rotation a quantity of a suitable adhesive is directed by means of a suitable nozzle onto the continuous juncture within the tubular sidewall between the inner surface thereof and the outer periphery of the bottom closure to thereby form the continuous bead or fillet of adhesive 72 or 110 to provide a fluid-tight seal therebetween. A suitable adhesive for the formation of the continuous feed or fillet is a hot melt lutting designated as Finley No. 295-337.

After the application of the adhesive bead or fillet, the partially assembled container is moved or indexed to a second finishing station where the open upper end portion of the tubular sidewall is either folded inwardly and downwardly or rolled radially outwardly into an outwardly rolled lip to form an annular end face thereon. The formation of the annular end face on the container can be accomplished by means of a suitable rotating head which moves in coaxial alignment with the tubular sidewall.

The thus partially assembled container is then ready to be filled with suitable contents such as the previously mentioned cigarettes, cigars or cigarillos. After the partially assembled container is filled with the desired contents, a suitable top closure seal 20 or 20*a* is applied to the respective annular end face of the container to seal the contents therein. Subsequently, a suitable lid 18 or 18*a* is applied to the upper end portion of the respective container 10 or 10*a* over the top closure seal to complete the packaging of the contents of the container.

When the contents of the thus described container are to be removed by a consumer, the lid is first removed from the container and then the removable top closure seal is removed, thus breaking the fluid-tight seal. In order to facilitate the grasping of the contents thereof, for example, cigarettes, cigars or cigarillos, the consumer holds the open container upright and applies gentle pressure to the bottom closure thereof in an upward direction until the bottom closure snaps upwardly thus thrusting the cigarettes, cigars, or cigarillos in the center portion of the container upwardly above the items nearer the inside wall of the tubular sidewall, whereby the upwardly thrust items can be easily removed from the container with the fingers. The minute it is desired to reclose the container, gentle downward pressure on the upper end portion of the upwardly thrust items will cause the bottom closure to snap downwardly into its original position, thus repositioning the upper ends of the items even with one another and substantially flush with the open end of the container. The lid can then be replaced on the open upper end of the container to maintain freshness of the contents of the container.

Changes may be made in the combination and arrangement of parts or elements is heretofore set forth in the specification and shown in the drawings without departing from the spirit and scope of the invention as defined and limited only by the following claims.

That which is claimed is:

1. A container comprising:

a tubular container sidewall having an inner surface and an outer surface and upper and lower open ends, and said upper open end having an end face; and bottom closure means disposed within said tubular container sidewall for closing said open lower end of said sidewall said bottom closure means having a center portion lying in a plane generally normal to the longitudinal axis of said container sidewall; a first tapered portion communicating at the upper end portion thereof with said center portion and tapering downwardly and outwardly from said center portion toward said lower end of said tubular container sidewall; a first upwardly concave portion communicating with the lower end portion of said first tapered portion; and a second tapered portion communicating at the lower end portion thereof with said first upwardly concave portion and tapering upwardly and outwardly from said first upwardly concave portion toward said upper end of said tubular container sidewall.

2. A container in accordance with claim 1 characterized further to include:

removable closure means releasably adhered to the end face of the upper end of said tubular container sidewall.

3. A container in accordance with claim 1 characterized further to include:

top closure means for closing the upper end of said tubular sidewall.

4. A container in accordance with claim 3 wherein said top closure means is characterized further to include:

a tubular closure sidewall having an inner surface and an outer surface and a closed upper end and an open lower end, said tubular closure sidewall being sized so that the inner surface thereof is closely receivable about the outer surface of said tubular container sidewall.

5. A container in accordance with claim 4 wherein said top closure means is characterized further to include:

removable closure means releasably adhered to the annular end face of the upper end of said tubular container sidewall.

6. A container in accordance with claim 5 wherein said bottom closure means is formed of a unitary homogeneous mass of synthetic resin material.

7. A container in accordance with claim 5 wherein said bottom closure means is formed of a sheet of synthetic resin material of uniform thickness.

8. A container in accordance with claim 1 wherein said bottom closure means is formed of a unitary homogeneous mass of a normally solid thermoplastic material.

9. A container in accordance with claim 8 wherein said normally solid thermoplastic material comprises an alpha olefin polymer.

10. A container in accordance with claim 5 wherein said bottom closure means is formed of a unitary homogeneous mass of polyethylene.

11. A container in accordance with claim 1 wherein said tubular container sidewall comprises:

a generally rectangular paperboard container sidewall blank having first and second end faces and first and second side edges, said first side edge overlying said second side edge and being adhered to said second side edge by sidewall adhesive means.

12. A container in accordance with claim 11 wherein said sidewall adhesive means comprises a thermoplastic synthetic resin material.

13. A container in accordance with claim 11 wherein said paperboard container sidewall blank is coated on at least one side thereof with a film of thermoplastic synthetic resin material.

14. A container in accordance with claim 13 wherein said film of synthetic resin material forms the inner surface of said tubular container sidewall.

15. A container in accordance with claim 1 wherein said bottom closure means is characterized further to include:

a skirt on the outer periphery of said bottom closure means, said skirt extending downwardly toward said lower end of said tubular container sidewall and being enfolded by a radially inwardly rolled lip of said tubular container sidewall.

16. A container in accordance with claim 15 wherein said skirt terminates at the lower end portion thereof in an outwardly extending flange portion.

17. A container in accordance with claim 15 wherein said bottom closure means is characterized further to include:

a third tapered portion communicating at the lower end portion thereof with the upper end portion of said second tapered portion and tapering upwardly and outwardly from said second tapered portion toward said upper end of said tubular container sidewall; and a generally laterally extending portion communicating between the upper end portion of said third tapered portion and the upper end portion of said generally cylindrical skirt.

18. A container in accordance with claim 17 characterized further to include adhesive means disposed along the periphery of said bottom closure means and communicating between said bottom closure means and said tubular container sidewall.

19. A container in accordance with claim 15 characterized further to include adhesive means disposed along the periphery of said bottom closure means and communicating between said bottom closure means and said tubular container sidewall.

20. A container in accordance with claim 1 characterized further to include adhesive means disposed along the periphery of said bottom closure means and communicating between said bottom closure means and said tubular container sidewall.

21. A method of assembling a container, comprising:

forming bottom closure means from a mass of resilient material into a configuration comprising a central portion; a first tapered portion having an upper end portion and a lower end portion and communicating at the upper end portion thereof with said central portion and tapering outwardly from said central portion toward the lower end portion of said first tapered portion; a first upwardly concave portion communicating with the lower end portion of said first tapered portion and facing toward the upper end portion of said first tapered portion; and a second tapered portion having a lower end portion and an upper end portion and communicating at the lower end portion thereof with said first upwardly concave portion and tapering outwardly from said first upwardly concave portion toward the upper end portion of said second tapered portion;

positioning a tubular container sidewall having an inner surface and an outer surface and upper and lower open ends around said thus formed bottom closure means with said bottom closure means positioned adjacent the lower open end of said tubular container sidewall with said first upwardly concave portion of said bottom closure means facing toward the upper open end of said tubular container sidewall; and securing the periphery of said bottom closure means to said tubular container sidewall to close the lower end thereof so as to form an at least partially assembled container.

22. A method in accordance with claim 21 characterized further to include:

applying a removable seal to the open upper end of said tubular container sidewall to seal the upper end of said tubular container sidewall closed.

23. A method in accordance with claim 21 characterized further to include:

folding the open upper end of said tubular container sidewall inwardly and downwardly against the inner surface of said tubular container sidewall to form an end face on the upper end of said tubular container sidewall.

24. A method in accordance with claim 23 characterized further to include:

applying a removable seal to the end face on the upper end of said tubular container sidewall to seal the upper end of said tubular container sidewall.

25. A method in accordance with claim 21 characterized further to include:

filling said thus formed at least partially assembled container with items to be contained therein; and thereafter applying a removable seal to the open upper end of said tubular container sidewall to seal the upper end of said tubular container sidewall and thereby seal said items within said container.

26. A method in accordance with claim 25 wherein said items are selected from the group consisting of cigarettes, cigars and cigarillos.

27. A method in accordance with claim 26 wherein said items are positioned within said container with the longitudinal axes of said items parallel to the longitudinal axis of said tubular container sidewall.

28. A method in accordance with claim 21 wherein the configuration of said bottom closure means resulting from said forming step is characterized further to include:

a downwardly extending skirt on the outer periphery of said bottom closure means, said skirt extending toward the lower end portion of said second tapered portion; and wherein said step of securing the periphery of said bottom closure means includes:

forming the lower open end of said tubular sidewall into an inwardly rolled lip so as to enfold said skirt.

29. A method in accordance with claim 28 wherein the configuration of said bottom closure means resulting from said step of forming said bottom closure means is characterized further to include:

a third tapered portion having a lower end portion and an upper end portion and communicating at the lower end portion thereof with the upper end portion of said second tapered portion and tapering outwardly from said second tapered portion toward the upper end portion of said third tapered portion; and a generally laterally extending portion communicating between the upper end portion of said third tapered portion and the upper end portion of said downwardly extending skirt.

30. A method in accordance with claim 21 wherein said mass of resilient material is a sheet of normally solid thermoplastic material of uniform thickness; and wherein said step of forming said bottom closure means is performed by applying heat and pressure to said sheet of normally solid thermoplastic material to form said sheet of normally solid thermoplastic material into said configuration.

31. A container in accordance with claim 17 wherein said central portion, said tapered portions, said upwardly concave portion, said generally laterally extending portion and said skirt are coaxially aligned.

32. A container in accordance with claim 1 wherein said bottom closure means is characterized further to include:

a first downwardly concave portion communicating with the upper end portion of said second tapered portion;

a third tapered portion communicating at the upper end portion thereof with said first downwardly concave portion and tapering downwardly and outwardly from said first downwardly concave portion toward said lower end of said tubular container sidewall; and a second upwardly concave portion communicating with the lower end portion of said third tapered portion.

33. A container in accordance with claim 32 wherein said bottom closure means is characterized further to include:

a fourth tapered portion communicating at the lower end portion thereof with said second upwardly concave portion and tapering upwardly and outwardly from said second upwardly concave portion toward said upper end of said tubular container sidewall; and a second downwardly concave portion communicating with the upper end portion of said fourth tapered portion.

34. A container in accordance with claim 32 wherein said bottom closure means is characterized further to include:

a fourth tapered portion communicating at the lower end portion thereof with said second upwardly concave portion and tapering upwardly and outwardly from said second upwardly concave portion toward said upper end of said tubular container sidewall;

a second downwardly concave portion communicating with the upper end portion of said fourth tapered portion; and a generally laterally extending portion communicating with said second downwardly concave portion and extending generally laterally outwardly therefrom.

35. A container in accordance with claim 33 characterized further to include adhesive means disposed along the periphery of said bottom closure means and communicating between said bottom closure means and said tubular container sidewall.

36. A container closure comprising:

a central portion;

a first tapered portion having an upper end portion and a lower end portion and communicating at the upper end portion thereof with said central portion and tapering outwardly from said central portion toward the lower end portion of said first tapered portion;

a first upwardly concave portion communication with the lower end portion of said first tapered portion and facing toward the upper end portion of said first tapered portion; and a second tapered portion having a lower end portion and an upper end portion and communicating at the lower end portion thereof with said first upwardly concave portion and tapering outwardly from said first upwardly concave portion toward the upper end portion of said second tapered portion.

37. A closure in accordance with claim 36 wherein said central portion is generally circular and said first upwardly concave portion is generally circular, and wherein the ratio of the diameter of said generally circular first upwardly concave portion to the diameter of said generally circular central portion is in the range from about 1.2 to about 2.3.

38. A closure in accordance with claim 36 wherein said central portion is generally circular and the outer periphery of said closure is generally circular and the ratio of the diameters of said generally circular outer periphery to the diameter of said generally circular center portion is in the range from about 5.5 to about 11.9.

39. A closure in accordance with claim 36 wherein said second tapered portion is in the shape of a frustum of a cone having an apical angle in the range from about 45° to about 165°.

40. A closure in accordance with claim 39 wherein said first tapered portion is in the shape of a frustum of a cone having an apical angle in the range from about 0° to about 120°.

41. A closure in accordance with claim 39 wherein said first tapered portion is in the shape of a frustum of a cone having an apical angle in the range from about 45° to about 115°.

42. A closure in accordance with claim 40 characterized further to include:

a first downwardly concave portion communicating with the upper end portion of said second tapered portion;

a third tapered portion having an upper end portion and a lower end portion and communicating at the upper end portion thereof with said first downwardly concave portion and tapering outwardly from said first downwardly concave portion toward the lower end portion of said third tapered portion; and, said third tapered portion being in the shape of a frustum of a cone having an apical angle in the range from about 85° to about 185°.

* * * * *